US005112195A

United States Patent [19]

Cox

[11] Patent Number: 5,112,195

[45] Date of Patent: May 12, 1992

[54] RADIAL FLOW ROTORS

[75] Inventor: John C. Cox, Derby, England

[73] Assignee: Rolls-Royce plc, London, England

[21] Appl. No.: 670,395

[22] Filed: Mar. 15, 1991

Related U.S. Application Data

[63] Continuation of Ser. No. 392,910, Aug. 14, 1989, abandoned.

[30] Foreign Application Priority Data

Oct. 19, 1988 [GB] United Kingdom ..... 8824463

[51] Int. Cl.[5] ..... F04D 29/38

[52] U.S. Cl. ..... 416/223 B; 416/179

[58] Field of Search ..... 416/179, 180, 183, 185, 416/186 R, 243, 188, 223 B; 29/889

[56] References Cited

U.S. PATENT DOCUMENTS

| | | | |
|---|---|---|---|
| 4,652,212 | 3/1987 | Burger et al. | 416/188 |
| 4,653,976 | 3/1987 | Blair et al. | 416/183 |

FOREIGN PATENT DOCUMENTS

| | | | |
|---|---|---|---|
| 267405 | 5/1988 | European Pat. Off. | 416/185 |
| 492190 | 3/1954 | Italy | 416/183 |
| 164100 | 7/1986 | Japan | 416/241 R |
| 21145 | 3/1900 | Sweden | 416/179 |
| 796599 | 3/1955 | United Kingdom . | |
| 838416 | 6/1956 | United Kingdom . | |
| 1312517 | 7/1970 | United Kingdom . | |
| 1495708 | 1/1974 | United Kingdom . | |
| 2164098 | 3/1986 | United Kingdom . | |
| 2166808 | 4/1986 | United Kingdom . | |
| 2168764 | 6/1986 | United Kingdom . | |
| 2199379 | 7/1988 | United Kingdom . | |

*Primary Examiner*—John T. Kwon

*Attorney, Agent, or Firm*—Cushman, Darby & Cushman

[57] ABSTRACT

The vanes of a radial turbine have pressure surfaces which are convex when viewed in a plane normal to the axis of rotation of the radial flow rotor and suction surfaces which are concave when viewed in the same plane. The curvature acts to promote favorable radial surface pressure gradients to assist the control of boundary layer migration in the intervane passages and also increase the structural integrity of the vane members. The otherwise flexible extremities of the vane members are stiffened by introducing the curvature, as the natural resonant vibration frequencies of the vanes are changed. The invention is also applicable to the vane members of a radial or mixed flow impeller in gas or other fluid applications.

7 Claims, 3 Drawing Sheets

RADIAL FLOW ROTORS

This is a continuation of application Ser. No. 392,910, filed on Aug. 4, 1989, which was abandoned upon the filing hereof.

This invention relates to radial flow rotors used in gas or other fluid turbine engines for compression or energy extraction purposes.

Taking a turbine application for example, the rotating vane members of a radial flow turbine extract energy from motive gases flowing through it. The vanes are designed to extract the energy as efficiently as possible to rotate the turbine and provide mechanical torque. The efficiency of the radial turbine is however deleteriously effected as the energy exchange and transmission is subject to mechanical, thermodynamic and aerodynamic losses. The aerodynamic losses include losses due to secondary flows in the passages between adjacent vanes.

These secondary flows entrain fluid from the surface boundary layer and transport it under the influence of static pressure gradients from the vane pressure surface to the adjacent suction surface across the passage end walls. The resulting flows have velocity vectors substantially different from the mainstream flow vectors of the motive gas and so increase the aerodynamic losses incurred.

One objective of the present invention is to assist in the control of boundary layer migration in the intervane regions.

The rotating vane members of the radial flow turbine are also subjected to both mechanical and aerodynamic sources of excitation which can result in resonant vibration or flutter when interactions occur with the natural frequency responses of the rotor assembly. A further objective of the present invention is to provide a means of modifying the natural resonant vibration frequencies of the radial flow rotor.

According to the present invention a radial flow rotor has an axis of rotation and is provided with a plurality of generally axially extending vanes, the vanes defining generally axially extending gas passages and being so configured that adjacent vane surfaces define pressure and suction surfaces, whereby at least a part of the axial extent of each of said vanes has a pressure surface which is convex in a spanwise direction.

Preferably at least a part of the axial extent of each of said vanes has a suction surface which is concave in a spanwise direction.

The spanwise curvature is preferably at the inlet or outlet of the radial flow rotor or through its entire streamwise length.

Each of said vanes is preferably defined by a stack of elemental aerofoil sections so as to have a curvature in the spanwise direction, said sections being stacked so that the pressure surface is convex in a spanwise direction. The suction surface is preferably concave in the same direction.

Figure 1:
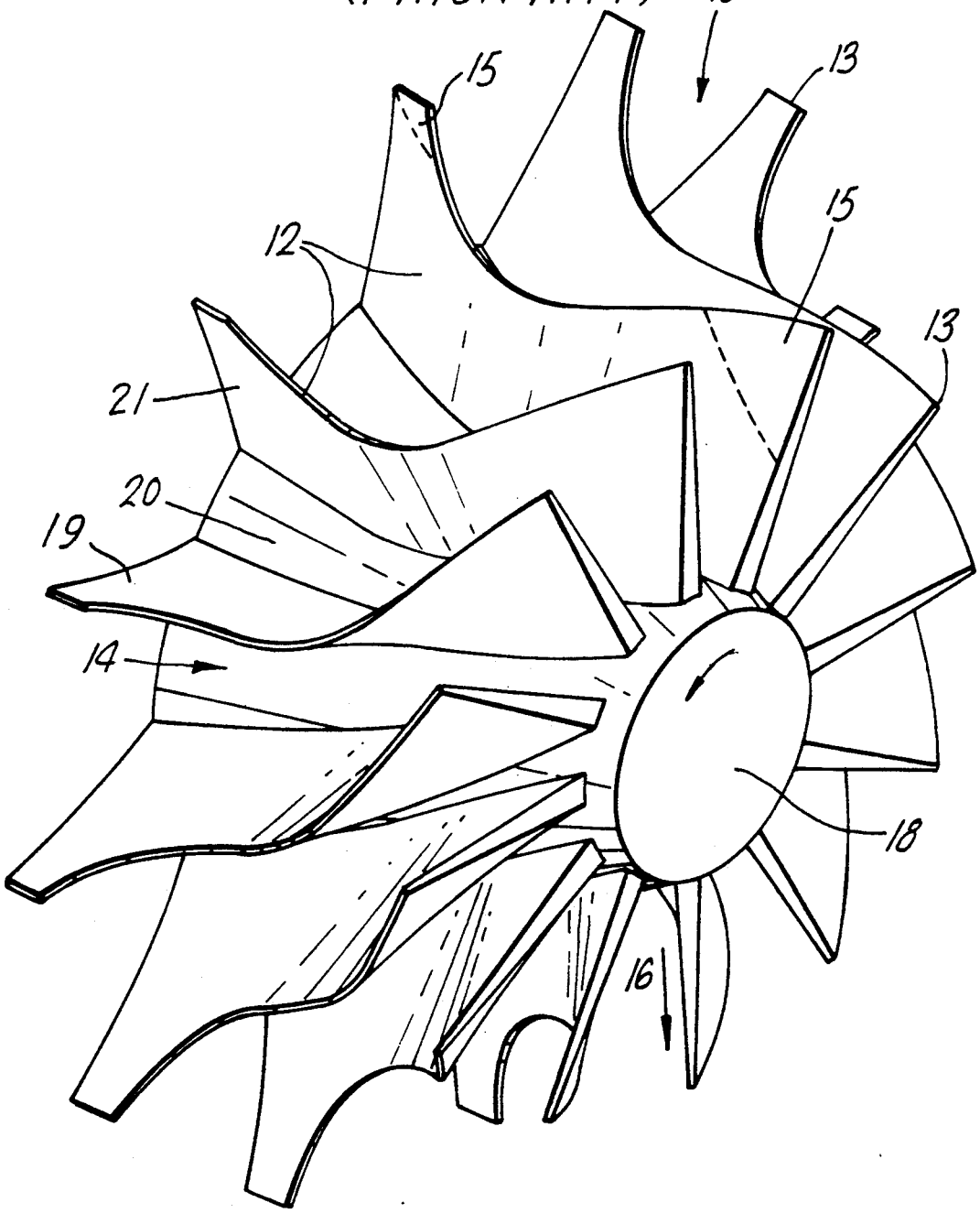
Fig. 1. (PRIOR ART)
Figure 2:
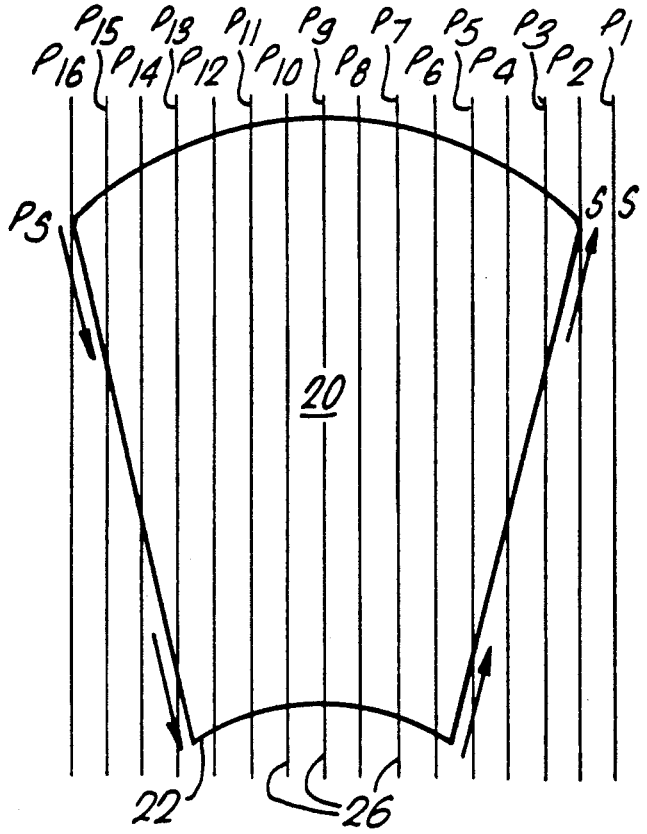
Figure 4:
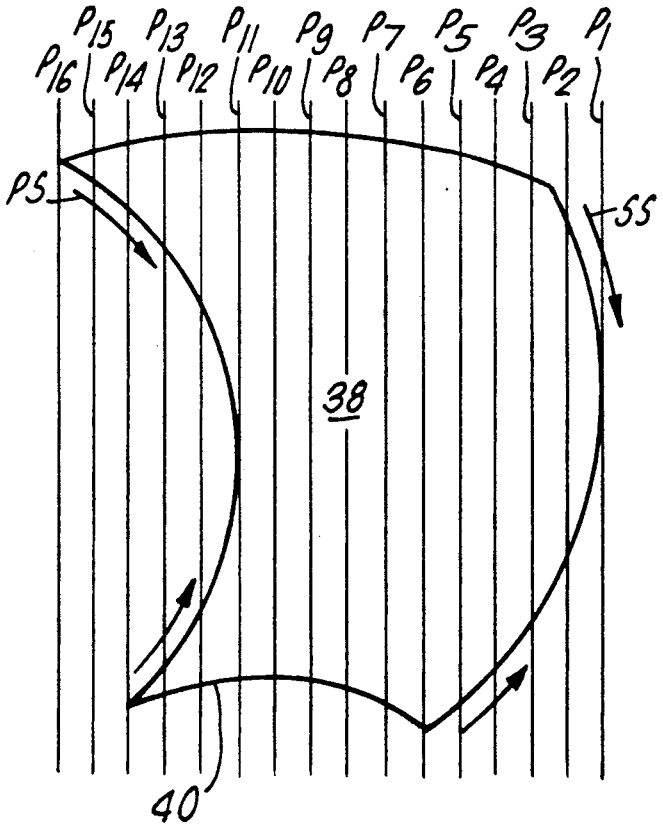
Figure 3:
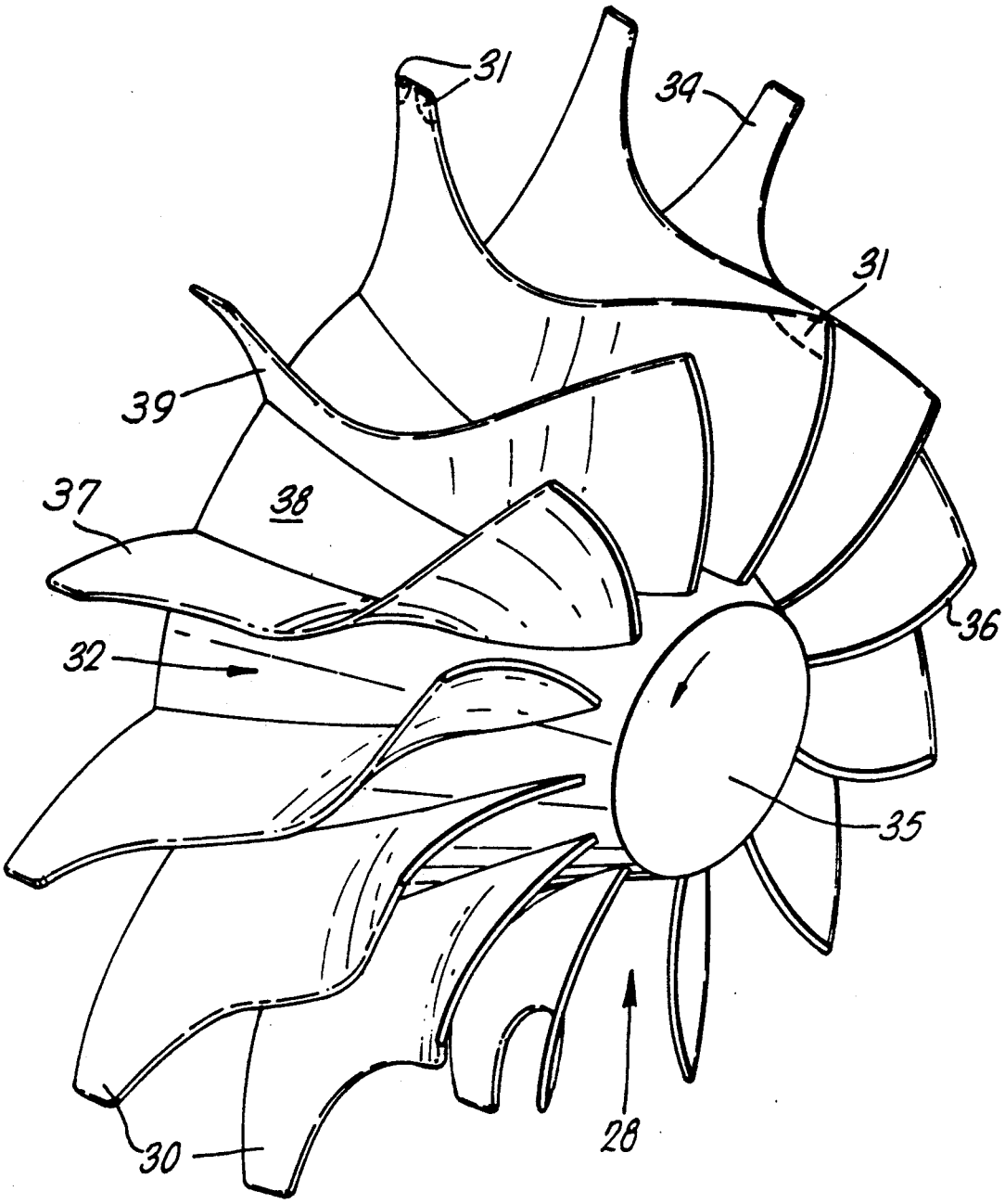

The invention will now be more particularly described with reference to the accompanying drawings in which, FIG. 1 (prior art) is a perspective view of a conventional radial turbine, which is not in accordance with the present invention, FIG. 2 (prior art) is a cross-sectional view through a flow passage defined by a pair of adjacent conventional vanes of the radial turbine shown in FIG. 1, FIG. 3 is a perspective view of a radial turbine in accordance with the present invention, FIG. 4 is a cross-sectional view through a flow passage defined by a pair of adjacent vanes of the radial turbine shown in FIG. 3.

FIG. 1 (prior art) shows, a conventional radial turbine having vanes 12 which have a curvature in the direction of mainstream flow 14. In a direction 16 normal to the mainstream flow direction 14 the vanes 12 extend radially from a central hub 18. Adjacent vanes 12 define a flow passage 20 through which a motive gas flows. A flow passage 20 is defined by a pressure surface 19 and a suction surface 21 of adjacent vanes 12. The turbine 10 rotates in anticlockwise direction about its axis as indicated by the arrow.

The flow passage 20, shown in FIG. 2 (prior art), is defined by a suction surface (SS) of one vane 12, a pressure surface (PS) of an adjacent vane 12 and inner 22 and outer 24 circumferential end walls. The inner wall 22 is defined by the central hub 18 and the outer circumferential wall 24 is defined by an engine casing (not shown). The suction and pressure surfaces (SS and PS) are both radial in extent and intersect contours of constant static pressure 26, operationally present in the flow passage 20.

The contours of constant static pressure 26 present in the flow passage 20 are highest near the pressure surface PS at $P_{16}$, and decrease across the flow passage 20 to a lower pressure $P_1$, near the suction surface (SS). The arrows show the direction of the pressure gradient in a decreasing sense.

The motive gas flowing through the flow passage 20 in the mainstream flow direction 14, interacts with the vanes 12 resulting in a low velocity boundary layer at the surface of the vanes 12. The boundary layer tends to migrate from the pressure surface (PS) to the suction surface (SS) of an adjacent vane 12 along the inner 22 and outer 24 endwalls, under the influence of the pressure gradients indicated by the arrows in FIG. 2 (prior art). This cross passage flow or secondary flow has a velocity vector which differs substantially from the mainstream flow vectors of the motive gas resulting in aerodynamic losses.

The tip regions 13 of the vanes 12 are circumferentially unsupported and susceptible to flap. Flap or torsional vibrational modes occur along typical nodes 15.

The design of vanes according to the present invention aims to stiffen the rotating vanes, particularly at the tip extremities 13, and to promote a favorable radial surface pressure gradient to assist in control of the boundary layer migration in the intervane region.

FIG. 3 shows a radial turbine 28 in accordance with the present invention having vanes 30 which have a curvature normal to the mainstream flow direction 32. The curvature may be introduced at the inlet 34 or outlet 36 extremities of the vanes 30 or through the entire streamwise length of the vanes. A flow passage 38 is defined by a pressure surface 37 and a suction surface 39 of adjacent vanes 30. The turbine 28 rotates in an anticlockwise direction about its axis as indicated by the arrow.

In FIG. 4, the flow passage 38 is defined by a convex pressure surface (PS) of one vane 30, a concave suction surface (SS) of an adjacent vane 30 and inner 40 and outer 42 circumferential end walls. The inner wall 40 is defined by a central hub 35 and the outer circumferential wall 42 is defined by an engine casing (not shown).

By introducing convexity to the pressure surface (PS) of the vanes 30, the pressure surface (PS) intersects a number of contours of constant static pressure. The extremities of the pressure surface (PS) intersect contours of higher static pressure $P_{16}$ and $P_{14}$ while the central point of the pressure surface (PS) intersects a contour of lower static pressure $P_{11}$. The convexity introduced thereby results in the promotion of a favorable static pressure gradient along the pressure surface (PS), shown by the solid arrows in FIG. 4. The arrows show the direction of the pressure gradients in a decreasing sense. The boundary layer at the pressure surface of the vane 30 therefore encounters pressure gradients which resist its migration across the endwall 40 to the suction surface where it would otherwise be entrained in the secondary flow.

By the introduction of concavity to the suction surface (SS) of the vane 30, the extremities intersect contours of constant static pressure $P_2$ and $P_6$ while the central point of the suction surface (SS) intersects a contour of lower static pressure $P_1$. The solid arrows show the direction of the pressure gradients in a decreasing sense on the suction surface (SS). The boundary layer flow at the suction surface (SS) therefore encounters pressure gradients which resist its migration across the endwall 42.

Although suction surface concavity is shown, the curvature of the suction surface may in fact, vary. The curvature introduced to the suction surface will depend on the stressing criteria necessary to generate the pressure surface convexity.

The spanwise curvature introduced promotes favorable radial surface pressure gradients which energize movement of the boundary layer to resist its migration from the pressure surface towards the suction surface where it would otherwise be entrained in the secondary flow. Aerodynamic losses are thereby reduced as disturbance to the mainstream flow is minimized.

As well as assisting in the control of boundary layer migration across the endwalls of inter-vane passages the curvature introduced also increases the structural integrity of the vanes 30. The spanwise curvature acts to stiffen the otherwise flexible extremities of the vanes by increasing the natural resonant vibration frequencies of the vanes 30. The modification of the modal patterns by the curvature is indicated at 31. Although the example shown, illustrates pressure surface convexity it will be appreciated to those skilled in the art that a curvature distribution in any spanwise direction will stiffen the vanes 30.

The aerodynamic profile of such unconventionally shaped vanes 30 may be defined by stacking a number of elemental aerofoil sections such that each element of the trailing edge is normal to local primary flow streamlines of the motive gases. Application of this where the turbine exhaust is not parallel to the axis of rotation, can invoke the multilean stacking concept which ensures that fluids exhaust orthogonally from the passage as per the requirements of patent application number GB2164098A.

While the invention has been described in relation to a radial turbine it will be appreciated to those skilled in the art that the same principles can be applied to any radial or mixed flow impeller in gas or other fluid applications.

The radial flow turbine or impeller may comprise turning vanes in combination with partial turning vanes, customarily known as splitters. The invention is applicable to both full turning vanes and splitters, whether used singly or in combination.

I claim:

1. A radial turbine engine including a radial flow turbine, the radial flow rotor having an axis of rotation and being provided with a plurality of generally axially extending vanes, the axially extending vanes of the radial flow rotor defining generally axially extending gas passages, the axially extending vanes of the radial flow rotor defining the axially extending gas passages being so configured that adjacent surfaces of each of the axially extending vanes define pressure and suction surfaces, whereby during operation of the radial flow rotor, at least a part of the axial extent of each of said axially extending vanes has a pressure surface which is convex in a radial direction.

2. A radial flow turbine which extracts energy from a flow of gas passing from an input side of the turbine to an output side of the turbine, the radial flow turbine having an axis of rotation and comprising a plurality of vanes which extend both in an axial direction and in a radial direction, the vanes defining generally axially extending gas passages through which said flow of air passes to rotate the turbine in a rotational direction about said axis, each of said vanes having a first surface which defines a boundary of a first of said gas passages, said each vane also having a second surface which defines a boundary of adjacent gas passages, said first surface having a portion and said second surface having a portion so that the flow of gas through said first gas passage generates a higher pressure on said portion of the first surface than the flow of gas through said adjacent gas passage generates on said portion of said second surface, said portion of the first surface and said portion of the second surface being surfaces which form opposing surfaces of said each vane, said flow of gas over said portion of the first surface and said flow of gas over said portion of the second surface causing a force to be generated in said rotational direction, said portion of said first surface being convex in said radial direction.

3. A radial flow turbine as claimed in claim 2 in which at least a part of the axial extent of each of said vanes has a suction surface which is concave in a radial direction.

4. A radial flow turbine as claimed in claim 2 in which a portion of each vane at the inlet of the radial flow rotor is curved in a spanwise direction.

5. A radial flow turbine as claimed in claim 2 in which a portion of each vane at the outlet of the radial flow rotor is curved in a spanwise direction.

6. A radial flow turbine having an axis of rotation and being provided with a plurality of generally axially extending vanes, the axially extending vanes of the radial flow turbine defining generally axially extending gas passages, the axially extending vanes of the radial flow turbine defining the axially extending gas passages being so configured that adjacent surfaces of each of the axially extending vanes define pressure and suction surfaces, each of said axially extending vanes being defined by a stack of elemental aerofoil sections, the elemental sections defining the axially extending vanes being stacked so as to have a curvature in a radial direction, the curvature of the stacked elemental sections being such that during operation of the radial flow rotor, the axially extending vanes have a pressure surface which is convex in a radial direction.

7. A radial flow turbine as claimed in claim 6 in which said sections are stacked so that the suction surface is concave in a radial direction.

* * * * *